United States Patent [19]

Parker

[11] Patent Number: 4,515,559

[45] Date of Patent: May 7, 1985

[54] HEAT TREATMENT METHOD AND APPARATUS

[75] Inventor: Gary F. Parker, Southport, England

[73] Assignee: Cooperheat, Merseyside, England

[21] Appl. No.: 520,811

[22] Filed: Aug. 5, 1983

[30] Foreign Application Priority Data

Dec. 16, 1982 [GB] United Kingdom ..... 8235905

[51] Int. Cl.[3] ..... F27D 5/00; F24J 3/00; F24H 3/00

[52] U.S. Cl. ..... 432/10; 165/47; 432/224

[58] Field of Search ..... 432/9, 10, 120, 224, 432/225; 165/22, 47

[56] References Cited

U.S. PATENT DOCUMENTS 3,529,811 9/1970 Grove ..... 432/10
4,309,583 1/1982 Krauss et al. ..... 432/225

FOREIGN PATENT DOCUMENTS 1443298 7/1976 United Kingdom .
1506800 4/1978 United Kingdom .
1592232 7/1981 United Kingdom .

OTHER PUBLICATIONS

Electric Power Research Institute Interim Report, Jul. 1982, EPRI NP2493, Project 1021-1.

*Primary Examiner*—John J. Camby
*Attorney, Agent, or Firm*—Brooks Haidt Haffner & Delahunty

[57] ABSTRACT

Heat treatment apparatus for annealing a reactor vessel includes an envelope having a plurality of insulated compartments each supplied with heated fluid from inlet ducts having nozzles in the compartments. The heated fluid passes out of the compartments via concentric tubular exhaust ducts. Heaters supplying the heated fluid are controlled by a mini-computer to ensure that a predetermined temperature profile is maintained across the heated section of the vessel.

16 Claims, 4 Drawing Figures

Figure 1:
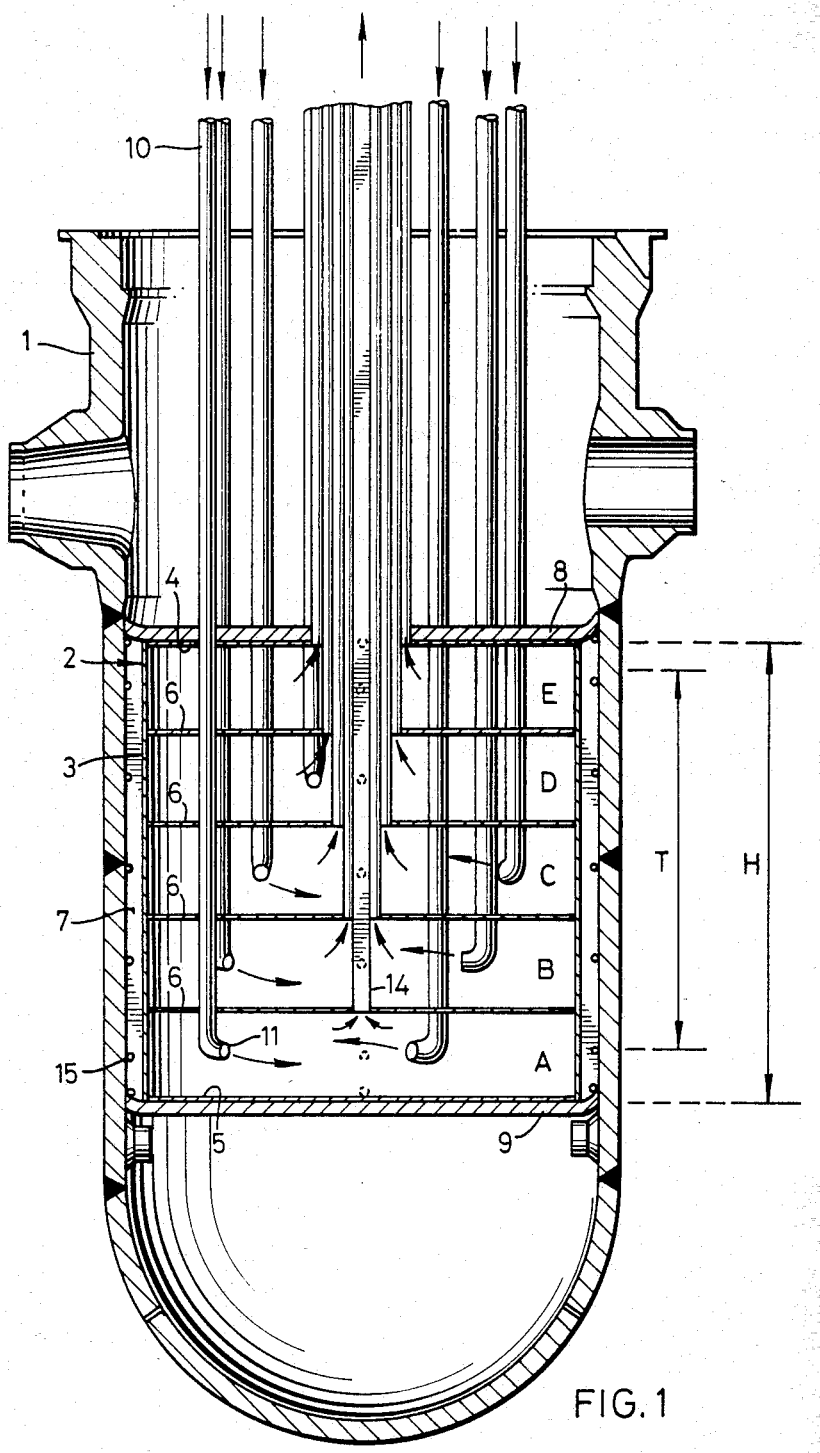

GAS FIRED
AIR HEATER
CONTROL
PANEL
A
B
C
D
E
11
12
13
13d
13e
13f

AIR
GAS
HEATED
AIR
13a
13b
13c
13d
13e
13f
12

HEAT TREATMENT METHOD AND APPARATUS

This invention relates to apparatus and a method for heat treating a vessel. The invention may be applied, for example, to anneal a reactor vessel, which has become embrittled as a result of fast neutron bombardment, whereby the vessel may be restored to a serviceable condition.

Some techniques for annealing a reactor vessel may involve circulating heated gases either within the interior of the vessel, or within a heat exchanger located within the interior of the vessel. In the former case, which employs forced convection, a section of the vessel may be provided with an inlet at one end for heated gases and an exhaust adjacent its other end, whereby the gases pass through the interior of the vessel and leave via the exhaust. In the latter case, which employs radiant heat, a heat exchanger consisting of coiled tubing may be located in the section of the vessel to be heat treated, the coils being provided with an inlet and outlet so that the heated gases circulate through the coils which thereby radiate heat to the adjacent interior wall portions of the section of the vessel to be heat treated. Whereas the latter technique overcomes the problem of contamination, i.e. the heated gases in the coils do not come into direct contact with the wall portions of the vessel, a disadvantage of both techniques is that insufficient control can be exercised, particularly over the range of from ambient to low temperatures, to provide a desired temperature profile down the sides of the wall portion of the vessel which are heat treated. If close control of the temperature profile cannot be maintained accurately during the annealing process, stringent quality control requirements may not be met and hence the annealed vessel may not be acceptable for future service.

The present invention seeks to provide a solution to this problem.

The present invention provides apparatus for heat treating a vessel, the apparatus comprising a plurality of inlet ducts; a plurality of exhaust ducts; and wall means defining a plurality of compartments; each of said compartments being provided with at least one of said inlet ducts and at least one of said exhaust ducts, and said wall means being such that a wall portion of each of said compartments is adjacent a wall portion of at least one other one of said compartments whereby said wall portions form respective parts of a radiating surface for radiating heat onto a confronting interior wall or wall portion of the vessel; the apparatus further including means for supplying heated fluid to each of said inlet ducts and for controlling the thermal input of the heated fluid supplied to the respective inlet ducts, each of said compartments being independent of the other so that their internal temperatures may be individually controlled by controlling the thermal inputs of the heated fluid supplied to the respective inlet ducts.

According to a preferred arrangement, the wall means define an envelope which is divided, by partitions, into the plurality of compartments. However, instead of dividing an envelope into a series of compartments, each compartment may be defined by its own envelope, the envelopes being assembled adjacent one another to form a unitary structure.

The invention also provides a method of heat treating a vessel, comprising the steps of:

(a) providing a series of independent closed heating zones within the interior of the vessel, each heating zone being bounded by part of a radiating surface,
(b) supplying heat fluid to each of said zones, and
(c) controlling the thermal input of the heated fluid to each zone so as to control its temperature and thereby provide a required temperature profile over said radiating surface and hence over a confronting interior wall or wall portion of said vessel.

The main advantage of the invention is that the internal temperature of each compartment can be carefully controlled, for example, to provide a required temperature profile over the interior wall or wall portion of the section of the vessel which is heat treated. This profile enables stringent requirements to be met during the annealing process. A further advantage is that a closed system is used, whereby the heated fluids do not come into contact with the internal wall or wall portions of the vessel being heat treated and hence there is no contamination problem.

In the preferred arrangement, each compartment is provided with a plurality of the inlet ducts, e.g. three ducts per compartment, which terminate in outlets or nozzles pointing in different directions. For example, with three inlet ducts, the outlets or nozzles may be situated at the apices of a triangle so that they are directed along the sides of the triangle. The exhaust ducts may be in the form of a plurality of concentric tubes, each tube communicating with a respective one of the compartments. Suitably, for the heat treatment of a cylindrical vessel, a cylindrical envelope is employed which is either divided into or made up by a series of cylindrical compartments forming respective sections of the cylinder. The outer cylindrical diameter is as large as possible, within the restraints of the reactor vessel design (i.e. to enable the heating apparatus to be inserted into the reactor vessel), in order to keep the annular gap between the heating apparatus and the internal wall or wall portions of the vessel as small as possible and thereby minimise thermal buoyancy effects within this gap. To further minimise this buoyancy effect, seals can be filled to the top and bottom of the main envelope.

Figure 2:
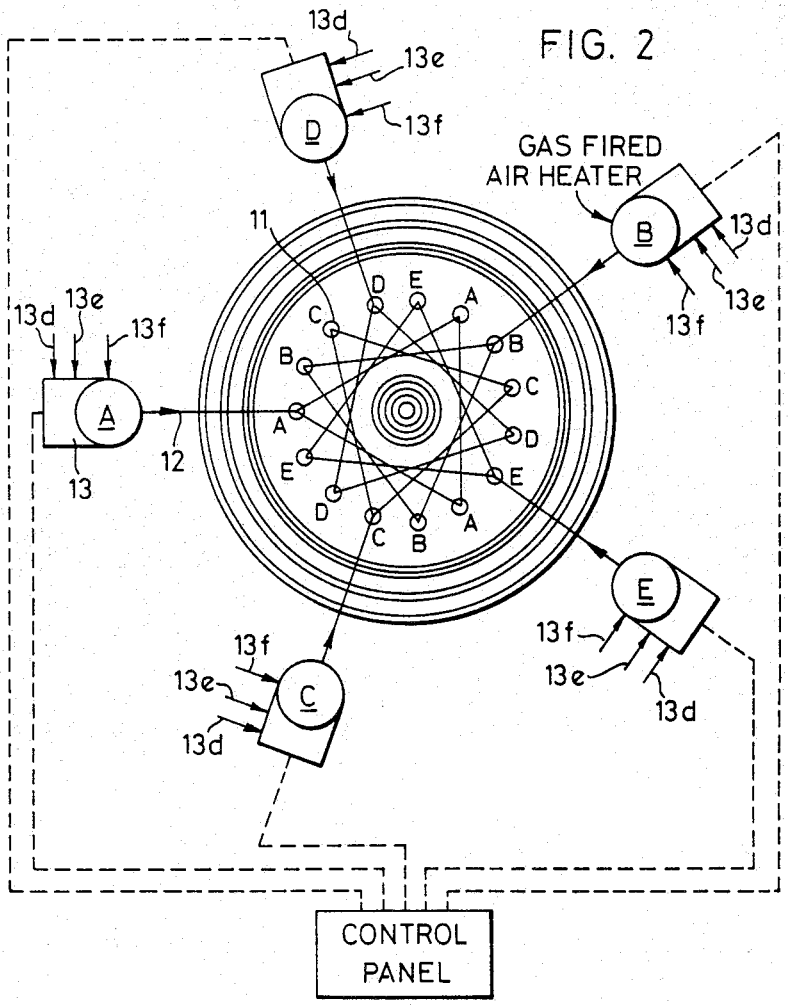
Figure 2A:
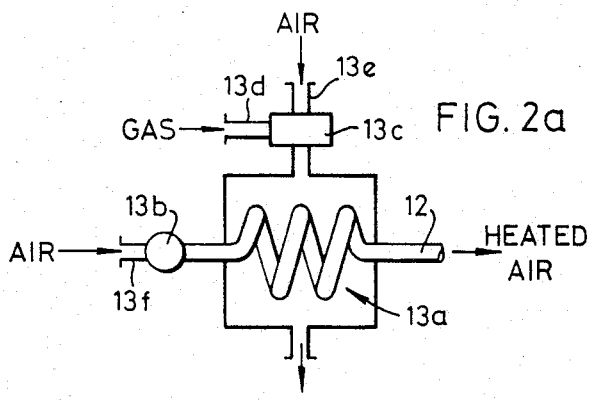
Figure 3:
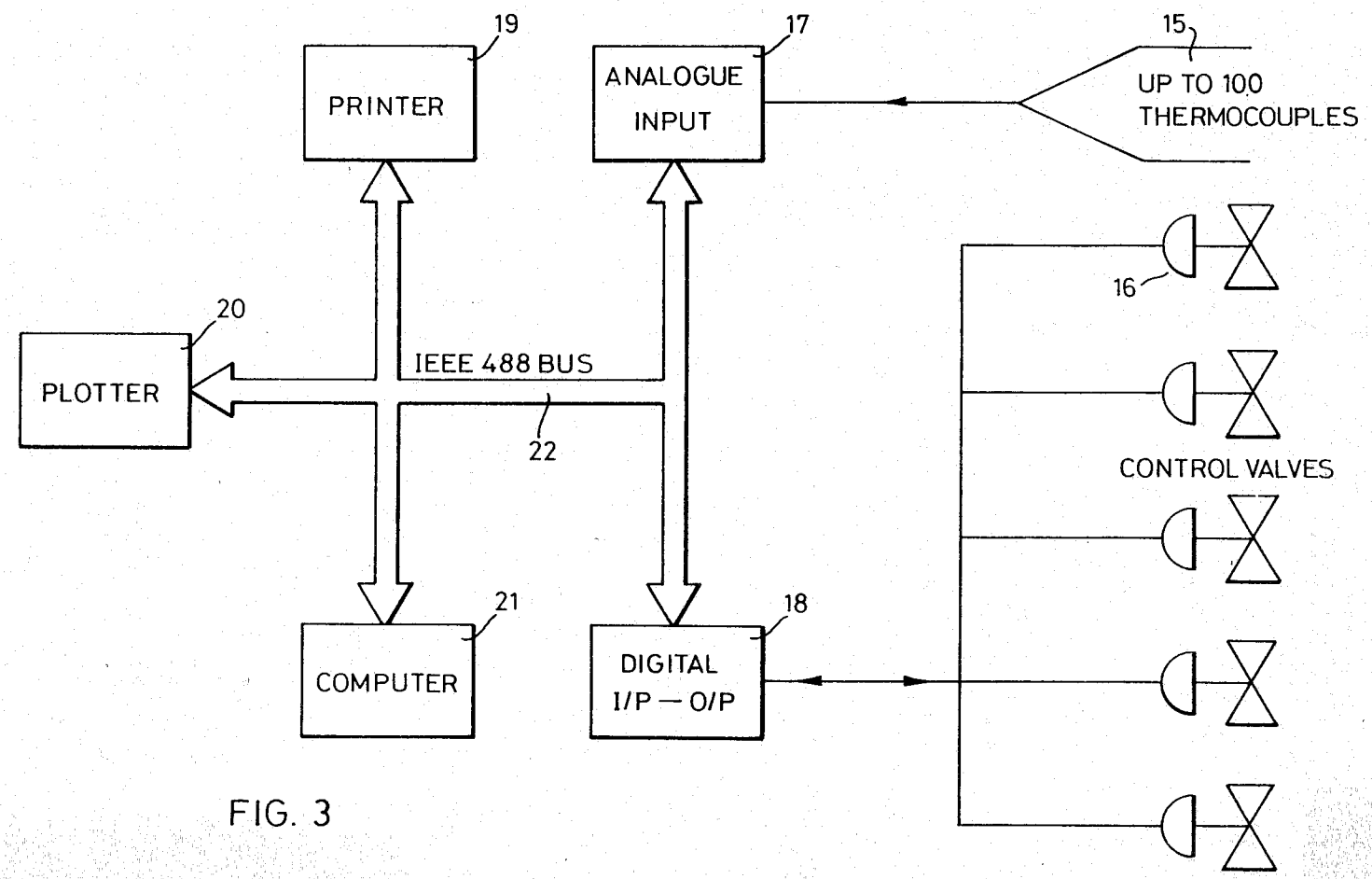

An example of the invention will now be described with reference to the accompanying schematic drawings, in which:

FIG. 1 is a sectional elevation showing heat treatment apparatus, according to an embodiment of the invention, located within a reactor vessel, FIGS. 2 and 2*a* is a plan view, in section, through the vessel shown in FIG. 1 and it indicates lines of flow of heated fluid from a plurality of outlet nozzles connected to inlet ducts, which are connected to means for supplying the heated fluid (shown in more detail in FIG. 2*a*), and FIG. 3 illustrates means for controlling the supply of heated fluid.

Referring to the drawings, a reactor vessel 1 is clad externally with mineral wood insulation (not shown) encased in stainless steel (not shown).

Heating apparatus for heat treating or annealing a section of the reactor vessel comprises a cylindrical envelope 2 having a cylindrical wall 3 constructed from lightweight steel material to minimise weight and to ensure a rapid response to temperature change. The cylindrical wall 3 is closed at its upper and lower ends by insulated disc-shaped walls 4,5 and is divided into a series of adjacent compartments A–E by means of a plurality of insulated bulkheads or partitions 6. The insulated bulkheads or partitions 6, which are also disc-shaped thermally insulate one compartment (A–E) from another to prevent transference of heat in the vertical direction.

The diameter of the cylindrical wall 3 is as large as possible, within the restraints of the reactor vessel design, to keep the annular gap 7 as small as possible, to minimise thermal buoyancy effects within this gap. To further minimise buoyancy effects, circular insulating seals 8,9 are fitted adjacent the upper and lower walls 4,5 of the envelope 2.

Each compartment A–E is provided with three insulated inlet ducts 10. These inlet ducts are fully insulated to prevent heat loss and to prevent transference of heat to, or between, the compartments A–E. The inlet ducts 10 terminate in outlets or nozzles 11, which are arranged to point in different directions. FIG. 2 shows how the inlet ducts 10 are symmetrically positioned in each compartment (A–E), whereby the nozzles 11 (not seen in FIG. 2) are symmetrically positioned at the apices of a cyclic figure, in this case a triangle, so that they are directed to expel heated fluid (e.g. heated air) along the sides of the triangle. FIG. 2 schematically indicates the triangular lines of flow of the heated fluid (such as heated air) from the nozzles in each of the compartments A–E (although these 'triangles' would be located one above the other in the compartments A–E and hence not normally seen in a sectional view). The 'triangles' are also relatively angularly displaced along the cylindrical axis of the envelope 1, to indicate that the nozzles 11 in each compartment are similarly displaced with respect to the nozzles 11 in an adjacent compartment.

The heated fluid, which is normally heated air, preferably is supplied by an indirect air heater or heaters (although direct high velocity gas burners could be used). As shown in FIG. 2, the three inlet ducts for each compartment are connected to a common duct 12 which is connected to the heated air outlet of a respective indirect air heater 13. The size of the inlet ducts 10 will depend on local conditions, in particular on the distance between the vessel and the air heaters 13.

The indirect air heaters 13 are of known design and each heater consists essentially of a double pass heat exchanger **13*a* fitted with a fan 13*b* and fired with single high velocity burner 13*c*, as shown schematically in FIG. 2*a*. The fan 13*b* provides a high velocity heated air flow and this ensures total temperature homogenuity within the respective compartment A–E. The use of an indirect air heater (i.e. one having a heat exchanger) greatly improves temperature control and this is important (as described below) with regard to controlling the internal temperatures of compartments A–E. Each heater 13 can provide, for example, a variable flow of heater air from ambient temperature to about 1470° (799° C.). Separate heaters 13 are preferably employed for supplying a heated air output to the respective one of the compartments A–E (although other arrangements are possible). The heated air output from the heat exchanger 13*a* of each heater 13 is preferably controlled by automatically adjusting process air flow temperature (e.g. by adjusting the fuel gas supply rate to the high velocity gas burner 13*c*) whilst the fan 13*b* maintains a constant flow of process air through the heat exchanger 13*a***. However, it would be possible to control the thermal output of each heater by regulating the process air flow, or by regulating the process air flow and the process air temperature.

Each compartment A–E is also provided with an exhaust duct 14 which is located centrally of the insulating bulkheads 6, or in the case of compartment E, centrally of the insulating wall 4. These exhaust ducts are provided in the form of a series of concentric tubes whereby compartments B–E have annular exhaust ports and compartment A has a central exhaust port.

The compartments A–E are independent of one another, i.e. there is no gas (e.g. heated air) communication therebetween, whereby the internal temperature of each compartment can be separately controlled, e.g. by adjusting the fuel gas supply rate to the heaters 13. The common cylindrical wall 3, which forms the cylindrical wall portion of each compartment A–E, acts as a radiating surface to radiate heat onto a section of the internal cylindrical wall of the vessel 1. In the example shown in the drawings, compartments B–D thereby provide a heat treatment zone T within a heating zone H (FIG. 1). Compartments A and E provide temperature gradient regulation zones. The internal temperatures of compartments A and E are normally maintained at a lower temperature than the internal temperatures of compartments B–D during the annealing process. This provides the required temperature gradients, in the vertical direction, outside the heat treatment zone T.

For example, the aim is to provide a plateau-shaped temperature profile along the vertical length of the heating zone H (i.e. along the length of cylindrical wall section of the vessel). Such a profile has a substantially flat peak temperature region over the heat treatment zone T and sloping temperature regions, one at each end of the plateau, tailing off to cooler temperatures over the temperature gradient regulation zones. Thus, individual control of the heaters 13 can be effected so as to provide a substantially linear or flat temperature region over the heat treatment zone T, which temperature is gradually increased at a controlled rate to a predetermined annealing temperature, and is then gradually decreased at a controlled rate in order to carry out the annealing process. When heat treating a vertically orientated vessel, it may be necessary to supply a lower thermal input to the upper compartments than to the lower compartments, e.g. to A than to E, and possibly less to B than to D, in order to achieve a desired symmetrical plateau-shaped profile.

Generally when the heat treatment zone T is provided by three or more compartments, the central, or more central, compartments may require a lower thermal input than the outer compartments over the heating zone (e.g. less to C than to B or D) in order to achieve a flat or linear plateau in the temperature profile, because the central or more central compartments lose less heat due to being sandwiched between the outer compartments.

In order to provide temperature measurement over the heating zone H, thermocouples 15 (represented by small circles in FIG. 1) are attached to the stainless steel envelope 2 at regular spaced vertical intervals and at 90° radial positions. For example a total of 28 thermocouples can be fitted to the locations (small circles) as shown in FIG. 1, twenty of the thermocouples representing the annealing zone, four in each of five circumferential bands adjacent compartments A–E, together with a band above and below giving gradient temperature information. The thermocouples 15 are attached to the envelope 2 so as to allow its free entry into, and removal from the interior of the vessel. The thermocouples can be of the nickel-chromium/nickel-aluminium stainless steel sheathed type suitable for contact temperature measurement. In addition, the thermocouples are preferably protected around the contact area to minimise localised heating effects from the envelope 2. Copper-constantan compensating cable is preferably used for connecting the thermocouples to the control instrumentation. The positive lead (copper) is connected to the nickel-chromium conductor (non-magnetic) of the thermocouple, and the negative lead (constantan) is connected to the nickel aluminium conductor (magnetic) of the thermocouple. All thermocouples and compensating leads are preferably fitted with polarised plugs and sockets to ensure correct connection.

Whilst it would be possible to monitor the temperature measurement and to control the heaters 13 manually, automatic control is preferred. For example, each thermocouple is connected to a Hewlett Packard 85 P mini computer, data logger and plotter, which provides temperature control and print-out of information on temperature variations and trends during the annealing operation. On completing the heat treatment cycle, the appropriate documentation is available as a permanent record.

The Hewlett Packard mini computer and data logger can be utilised to record all temperatures at intervals, for example not exceeding 30 minutes and also to calculate trends and differentials in the temperatures measured throughout the heating cycle. For example, the thermocouples 15 provide outputs which are plotted to provide graphs of the temperatures measured during the annealing operation and graphs of axial and circumferential differential temperatures. The axial differentials are measured by comparing the outputs of each group of vertically spaced thermocouples as shown in FIG. 1. The circumferential differentials are measured by comparing the outputs of each group of four thermocouples 15 which are centrally situated either in the respective circumferential bands (corresponding to the compartments A–E), or which are situated in the upper and lower bands (to provide gradient temperature information). It is important to measure these differentials in order to achieve satisfactory close control during the annealing operation, particularly whilst the temperature of the vessel is gradually increased to the final annealing temperature. As explained above, the aim is to maintain a plateau-shaped temperature profile during the annealing process and this temperature profile should be maintained as evenly as possible around the circumference of the section of the vessel 1 which is heat treated. During the initial heating period, as the temperature is gradually increased, it is important not to increase the temperature too rapidly, since this might lead to unacceptable axial and/or circumferential temperature differentials. For example, the axial and circumferential differentials measured by the thermocouples adjacent compartments A–E should not vary by more than respective predetermined limit, for example, within the range of from 10°–20° C. (or even finer limits). Such control is maintained whilst the temperature is increased, for example, at a rate of 14° C./hr to the final annealing temperature of say 450° C. This ensures even heating of the section of the vessel during the annealing process.

Each of the air heaters 13 (FIG. 2) is provided with a motorised control valve 16 as shown in FIG. 3. FIG. 3 schematically illustrates a suitable control system which includes a Hewlett Packard mini-computer 21 interfacing via an IEEE 488 Bus 22 to the following four peripherals:

(a) an analog data acquisition unit 17, capable of scanning the thermocouples 15 in its basic mode, (b) a digital input/output unit 18, interfacing to the five motorised control valves 16 (which control the gas supply to the heaters 13, (c) a dot matrix printer 19, which can be an 80 column printer for producing hard copy of the timed and demand logs in an easily readable form, and (d) a plotter 20 which can be a flat bed graphics plotter for producing high quality graphs of the temperatures measured during the annealing operation and graphs of axial and circumferential differentials.

A constant voltage unit can also be fitted to the instrumentation in order to provide evidence of consistency and function throughout the heat treatment cycle.

The mini-computer 21 may be programmed to exercise control over the motorised valves 16 so as to achieve a predetermined rate of temperature increase (e.g. 14° C./hr) during the initial heating period. With regard to maintaining the predetermined limit for each circumferential differential temperature, one of the four thermocouples in each respective circumferential band provides an output to the mini computer 21 which acts as a reference for monitoring the rate of temperature increase. All four thermocouples also provide outputs which are compared, by the mini computer 21, in order to produce the differential information. If the circumferential differential temperatures in the respective band exceed the predetermined limits, the computer is programmed to reduce the rate of temperature increase until the differentials are within the predetermined limits. The mini computer 21 is similarly programmed to control the axial differential temperatures with regard to the groups of thermocouples 15 in the four axial positions.

The results of metallurgical and metanistic analysis has indicated that a satisfactory annealing can be achieved by the following:

(a) a rate of rise of temperature limited to a maximum of 25° F. (14° C.) per hour.

(b) annealing temperature range 800°–850° F. (427–454° C.)

(c) annealing period 168 hours at a constant annealing temperature (d) rate of fall of temperature limited to a maximum of 25° F. (14° C.) per hour.

Temperature measurement of the annealing and gradient zones is by means of the contact type thermocouples positioned around the circumference and at various elevations as mentioned above and the temperature readings form the basis of the control (within the annealing specification) via the Hewlett Packard computer which logs and plots temperature profiles, as mentioned above.

The annealing process used will depend on the nature of the vessel to be heat treated and the envelope 2 may be constructed accordingly (e.g. with regard to the number and dimensions of the compartments A–E; the number, dimensions and dispositions of the inlet ducts 10, outlet nozzles 11 and exhaust ducts 14; and the number of air heaters 13 which are used). The inlet ducts 10 communicating with each compartment may also be connected to respective heaters 13 for closer control of circumferential differentials (although these are less likely to vary than the axial differentials). Other forms of control may also be exercised, than that described above, to ensure that the required temperature profile is maintained throughout the annealing process. For example, a different type of computer can be used, the number and disposition of the thermocouples 15 can be varied, and the temperature measurement intervals may be shorter or longer.

It will be understood the heating apparatus and method of heat treating a vessel described above with reference to the accompanying drawings is but an example of the invention and that modifications and changes are possible without departing from the scope and spirit of the invention as defined in the following claims.

What is claimed is:

1. Apparatus for heat treating a vessel, the apparatus comprising a plurality of inlet ducts; a plurality of exhaust ducts; and wall means defining a plurality of compartments for containing a heated fluid, said wall means preventing heated fluid in a compartment from contacting the vessel; each of said compartments having an exterior wall portion and being provided with at least one of said inlet ducts and at least one of said exhaust ducts for supplying and removing the heated fluid to and from the interior of the compartment, and said wall means being such that the exterior wall portion of each of said compartments is adjacent the exterior wall portion of at least one other one of said compartments whereby the wall portions form respective parts of a radiating surface for radiating heat onto a confronting interior wall or wall portion of the vessel; the apparatus further including means for supplying heated fluid to each of said inlet ducts and for controlling the thermal input of the heated fluid supplied to the respective inlet ducts, each of said compartments being independent of the other so that their internal temperatures may be individually controlled by controlling the thermal inputs of the heated fluid supplied to the respective inlet ducts, said means for supplying heated fluid and for controlling the thermal input of the heated fluid being operable to maintain a predetermined temperature profile across said radiating surface during the heat treatment process.

2. Apparatus according to claim 1, wherein said wall means define an envelope which is divided, by partitions, into the plurality of compartments.

3. Apparatus according to claim 1, in which said means for supplying heated fluid to each of said inlet ducts and for controlling the thermal input of the heated fluid supplied to the respective inlet ducts comprise a heater or heaters connected to the duct or ducts supplying the heated fluid to said compartments, regulating means for regulating the thermal outputs of each of said heaters, temperature sensing means for providing output signals representing temperatures measured at intervals spaced axially of the vessel and at the vessel wall surface, and computer means responsive to said output signals for controlling said regulating means.

4. Apparatus for heat treating a vessel, the apparatus comprising:

(a) envelope means divided by partitions into a plurality of compartments, each of said compartments having a heat radiating wall portion which is adjacent the heat radiating wall portion of at least one other one of said compartments, whereby they form respective parts of a radiating surface for radiating heat onto a confronting wall portion of the vessel to be heat treated;

(b) inlet duct means connected to outlet nozzle means, each of said compartments having a plurality of said outlet nozzle means symmetrically situated therein and directed along the sides of a cyclic figure;

(c) exhaust duct means communicating with said compartments;

(d) insulating means insulating said compartments one from another except for said heat radiating wall portions of said compartments which are made of thermally conductive material to ensure rapid response to temperature change;

(e) means for supplying heated fluid to said inlet duct means, and (f) means for individually controlling the thermal inputs of the heated fluid supplied to said inlet duct means in order to maintain a predetermined temperature profile across said radiating surface during the heat treatment of said vessel.

5. Apparatus according to claim 4, wherein said envelope means is cylindrical and said partitions extend radially of the cylindrical axis so as to divide said envelope means into a plurality of cylindrical chambers.

6. Apparatus according to claim 5, wherein said exhaust duct means are concentric tubes coextensive with said cylindrical axis.

7. Apparatus according to claim 6, wherein said means for supplying heated fluid to said inlet duct means comprises respective gas burner means, and wherein said means for individually controlling said thermal inputs comprises regulating means for regulating the outputs of said respective gas burner means.

8. A heat exchanger for use in apparatus for heat treating a vessel, the exchanger comprising a closed envelope divided by a plurality of partitions into a series of independent compartments for containing a heated fluid, said envelope preventing heated fluid in a compartment from contacting the vessel, said envelope having an axial extent with respect to which said partitions are transversely situated, an exterior wall portion of each compartment, other than said partitions, forming a respective part of a heat radiating surface, and one or more inlet ducts and one or more exhaust ducts communicating with each respective compartment for supplying and removing the heated fluid to and from the interior of the compartment, said outlet ducts extending co-axially with said axial extent of said envelope.

9. A method of heat treating a vessel comprising the steps of:

(a) providing a series of independent, closed heating zones within the interior of the vessel for containing a heated fluid, each heating zone being bounded at the periphery thereof by part of a radiating surface;

(b) supplying heated fluid to each of said zones separately, and (c) controlling the thermal input of the heated fluid to each zone so as to control its temperature and thereby provide a required temperature profile over said radiating surface and hence over a confronting interior wall or wall portion of said vessel.

10. A method according to claim 9, wherein said profile is a plateau-shaped.

11. A method according to claim 9, wherein a computer is programmed to control the supply of said heated fluid to each of said zones to maintain the required temperature profile.

12. A method according to claim 9, wherein said heat treatment is an annealing process in which the temperature of said radiating surface is gradually increased at a predetermined rate to an annealing temperature, the annealing temperature is maintained for a predetermined period, and the temperature of said radiating surface is gradually decreased at a predetermined rate.

13. Apparatus for heat treating a vessel, the apparatus comprising a plurality of inlet ducts; a plurality of exhaust ducts; and wall means defining a plurality of compartments; each of said compartments being provided with a plurality of said inlet ducts and at least one of said exhaust ducts, each of said inlet ducts terminating in outlets or nozzles which point in different directions, and said wall means being such that a wall portion of each of said compartments is adjacent a wall portion of at least one other one of said compartments whereby said wall portions form respective parts of a radiating surface for radiating heat onto a confronting interior wall or wall portion of the vessel; the apparatus further including means for supplying heated fluid to each of said inlet ducts and for controlling the thermal input of the heated fluid supplied to the respective inlet ducts, each of said compartments being independent of the other so that their internal temperatures may be individually controlled by controlling the thermal inputs of the heated fluid supplied to the respective inlet ducts.

14. Apparatus according to claim 13, wherein said outlets or nozzles are symmetrically situated within each respective compartment and are directed along the sides of a cyclic figure.

15. Apparatus for heat treating a vessel, the apparatus comprising a plurality of inlet ducts; a plurality of exhaust ducts in the form of concentric tubes and wall means defining a plurality of compartments; each of said compartments being provided with at least one of said inlet ducts and at least one of said exhaust ducts, and said wall means being such that a wall portion of each of said compartments is adjacent a wall portion of at least one other one of said compartments whereby said wall portions form respective parts of a radiating surface for radiating heat onto a confronting interior wall or wall portion of the vessel; the apparatus further including means for supplying heated fluid to each of said inlet ducts and for controlling the thermal input of the heated fluid supplied to the respective inlet ducts, each of said compartments being independent of the other so that their internal temperatures may be individually controlled by controlling the thermal inputs of the heated fluid supplied to the respective inlet ducts.

16. Apparatus for heat treating a vessel, the apparatus comprising a plurality of inlet ducts; a plurality of exhaust ducts; and wall means defining a plurality of compartments; each of said compartments being provided with at least one of said inlet ducts and at least one of said exhaust ducts, and said wall means being such that a wall portion of each of said compartments is adjacent a wall portion of at least one other one of said compartments whereby said wall portions form respective parts of a radiating surface for radiating heat onto a confronting interior wall or wall portion of the vessel; the apparatus further including means for supplying heated fluid to each of said inlet ducts and for controlling the thermal input of the heated fluid supplied to the respective inlet ducts, each of said compartments being independent of the other so that their internal temperatures may be individually controlled by controlling the thermal inputs of the heated fluid supplied to the respective inlet ducts, said compartments being insulated one from the other except for said wall portions which form respective parts of said radiating surface, said wall portions being made of thermally conductive material to ensure rapid response to temperature change.

* * * * *